United States Patent [19]

Rom

[11] 4,406,199

[45] Sep. 27, 1983

[54] APPARATUS FOR MAKING COLLARS HAVING AN INTEGRAL NOTCHER

[75] Inventor: Rudolph A. Rom, Woodridge, Ill.

[73] Assignee: The Lockformer Company, Lisle, Ill.

[21] Appl. No.: 243,812

[22] Filed: Mar. 16, 1981

[51] Int. Cl.[3] ..... B26D 5/28

[52] U.S. Cl. ..... 83/212; 83/269; 83/693; 83/917; 72/421

[58] Field of Search ..... 72/130, 131, 129, 171, 72/172, 173, 133, 186, 420, 421; 83/355, 356.3, 501, 917, 693, 372, 524, 212, 262, 269; 234/47, 48

[56] References Cited

U.S. PATENT DOCUMENTS

| | | | |
|---|---|---|---|
| 1,582,217 | 4/1926 | Henry | 83/372 |
| 2,309,963 | 2/1943 | Krueger | 153/32 |
| 3,613,491 | 10/1971 | Kahmann | 83/524 |
| 3,982,457 | 9/1976 | Berry | 83/516 |
| 4,152,959 | 5/1979 | Elhaus | 83/372 |
| 4,228,672 | 10/1980 | Gale et al. | 72/130 |

*Primary Examiner*—Francis S. Husar
*Assistant Examiner*—Linda McLaughlin
*Attorney, Agent, or Firm*—McDougall, Hersh & Scott

[57] ABSTRACT

This invention provides a collar making apparatus having an integral notcher capable of forming a flat sheet of metal into a cylindrical collar. The notcher includes a stationary die and a ram mounted for reciprocation which includes a punch that cooperates with the die to stamp a notch in the sheet. The notcher further aligns a sheet to be punched and a control automatically operates the ram when a sheet is in the proper position for punching. From the notched sheet, the apparatus forms a channel along one side edge, forms the sheet into a circular configuration, and crimps the other side edge of the sheet.

15 Claims, 10 Drawing Figures

APPARATUS FOR MAKING COLLARS HAVING AN INTEGRAL NOTCHER

BACKGROUND OF THE INVENTION

This invention is generally directed to the field of collar making and, more specifically, to collars formed of sheet metal such as used in heating and ventilating systems. In such systems, heated or cooled air is carried by ducts to which pipes are connected at various positions for directing the air to individual rooms or areas. Collars are attached at holes formed in the duct wall and pipe sections are then attached to the collar.

In one collar design, one corner of a rectangular strip of sheet metal is notched on a stamping machine. The stamped strips of sheet metal are then taken to a conventional collar making machine for fabrication. The collar making machine forms a channel along the side edge of the strip having the notch, forms the strip into a circular configuration, and crimps the other side edge of the strip. The ends of the strip overlap each other and are secured together by conventional means such as spot-welding. Thus, what was originally the sides of the strip have now become the ends of a circular collar. The notch provides an opening in the outer wall of the channel which permits the channel end of the collar to be screwed into a hole in the duct wall which is dimensioned to receive the channel. The crimped end of the collar has a decreased diameter which allows a pipe section to be slipped over this end thereby facilitating attachment of the pipe to the collar. Producing such collars from strips of sheet metal which have been previously notched is well known.

PRIOR ART

U.S. Pat. No. 4,228,672, which is assigned to the assignee of the present invention, discloses a rotary notcher for forming a plurality of notches along an edge of a piece of sheet metal.

Another notching machine is disclosed in U.S. Pat. No. 3,982,457 in which separate machines perform notching, shearing, roll pressing, and coiling operations to fabricate a duct from an elongated strip of sheet metal.

An apparatus for making can bodies is disclosed in U.S. Pat. No. 2,309,963 in which a rectangular piece of sheet metal is notched in a separate operation before being fed to cylindrical can making machine.

SUMMARY OF THE INVENTION

This invention provides a collar making apparatus having an integral notcher whereby a flat sheet of metal may be introduced to one end of the apparatus, and a cylindrical collar having been notched, crimped and a channel formed along one edge will exit from the apparatus. The apparatus eliminates the necessity of having a separate stamping machine notch each sheet prior to being formed into a collar.

The apparatus includes a notcher which utilizes a stationary die and a ram mounted for reciprocation which includes a punch that cooperates with the die to stamp a notch in the sheet. The notcher also includes a means for aligning the sheet relative to the punch and die and a means for activating the reciprocally operated punch when the sheet is in the proper position.

Collars of various diameters may be automatically produced by this apparatus by selecting sheets of a predetermined length and by positioning the deflecting means in a corresponding predetermined position. The present apparatus thus provides a single machine for producing circular collars from a rectangular sheet of metal.

DESCRIPTION OF THE PREFERRED EMBODIMENT

Figure 1:
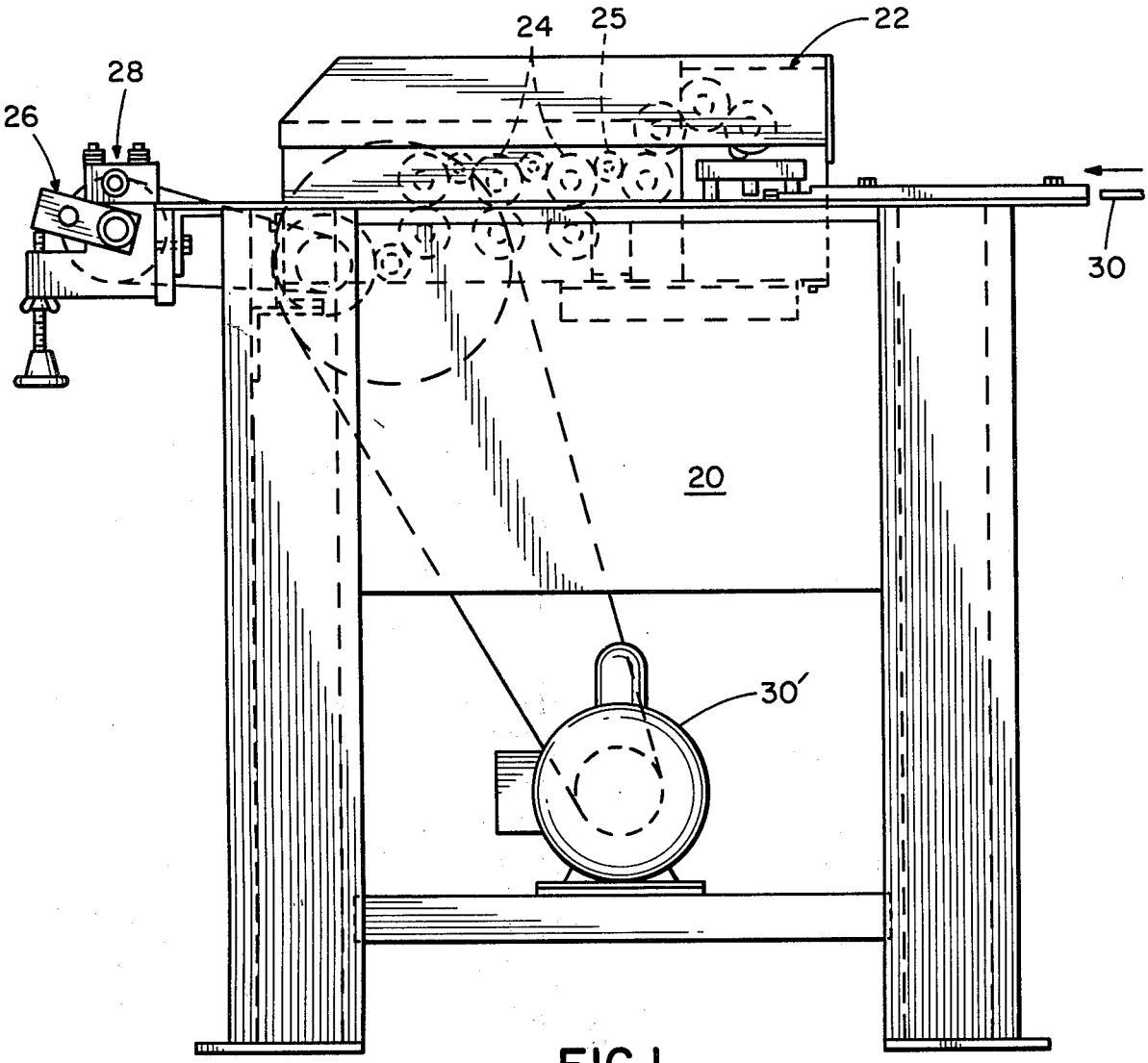
FIG. 1 is a side elevational view of an apparatus embodying the present invention.

The apparatus 20 of the present invention, generally illustrated in FIG. 1, includes a notcher 22, a channel forming means 24, such as a plurality of mating die rollers, a means 26 for deflecting the sheet into a cylindrical configuration having a predetermined diameter, and a means 28 which spirals the sheet into a circular configuration and simultaneously crimps one edge of the sheet. An electric motor 30' continuously drives the mating die roller pairs and the crimping means 28 which may consist of conventional mating rollers having knurled surfaces for crimping the sheet. Deflecting means 26 may consist of a conventional mating pair of rollers which engage the sheet and have their axes aligned so as to provide the proper radius of curvature to the sheet. Each die roller has a corresponding gear which mates with a gear of the mating die roller so as to provide synchronous drive between mating roller pairs. A set of idler gears 25 link each of the adjacent upper die rollers so as to provide the same speed of rotation for each of the successive die roller pairs.

A flat sheet 30 of metal enters apparatus 20 from the right and is notched by notcher 22. Thereafter, the sheet proceeds in a right to left path to have channel formed by die rollers 24 along one side edge. The sheet then proceeds to the deflecting and crimping portion of the apparatus wherein these final operations are performed. A sheet is automatically advanced through the apparatus upon engagement with the first die roller pair. Sheets can be manually fed to the notcher and from the notcher to the first die roller pair, or a suitable automatic feed mechanism can be incorporated.

Figure 2:
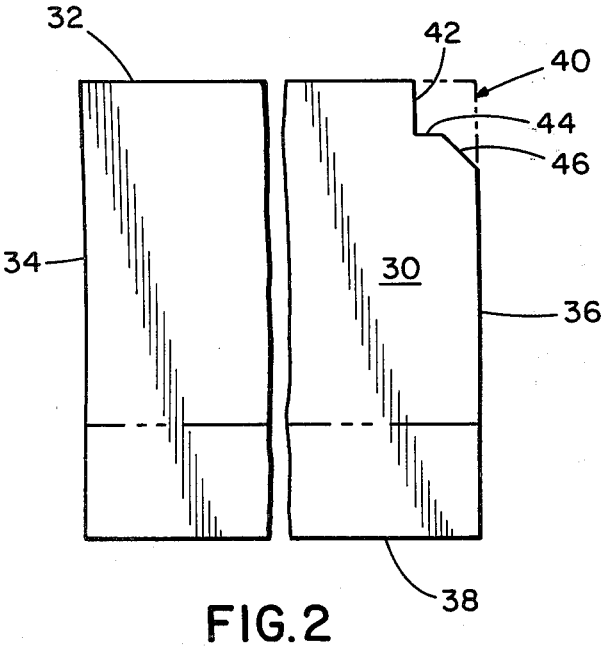
FIG. 2 is a top view of a sheet of metal illustrating its notched configuration.

As shown in FIG. 2, the flat sheet 30 includes a leading edge 32, side edges 34, 36 and a trailing edge 38. The notcher 22 removes a corner section 40 to leave this corner defined by edges 42, 44 and 46.

Figure 3:
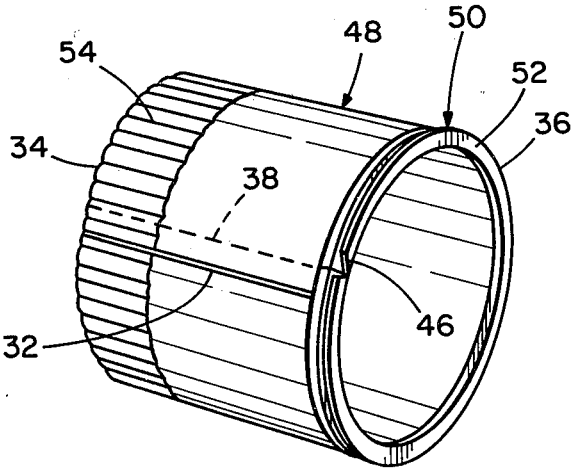
FIG. 3 is an isometric view of a cylindrical collar.

In FIG. 3, a completely formed collar 48 is shown including a channel 50 formed along edge 36 having an outside wall 52 and a series of crimps 54 formed adjacent edge 34. The leading edge 32 and the trailing edge 38 are overlapped and secured by conventional means such as spot welding. Edge 46 provides an opening in outer wall 52 of the channel which allows the collar to be screwed into a hole in a duct wall dimensioned to receive channel 50.

FIGS. 4–10 illustrate the construction of notcher 22 which includes a stationary die 56 and a ram 60 mounted for reciprocation that carries a punch 58 which engages the die 56 so as to sever corner section 40 of the sheet. The ram is reciprocated or cycled up and down by engagement with a wheel 64 which is eccentrically mounted to clutch 62 that can engage continuously driven gear 66. Solenoid 68 controls the engagement and disengagement of clutch 62. Electrical swtich 70, which monitors the position of movable stop 72 and electrical switch 74, which rides upon cam surface 76, cooperates to control solenoid 68.

The upper end 78 of stop 72 is disposed within a tubular opening 80 in support element 82. Stop 72 preferably consists of a metal rod. The lower end 84 of the stop is pivotally mounted to member 86 which is in turn pivotally mounted to fixed member 88. A spring 90 connected between member 88 and stop 72 urges the stop towards the right hand wall of opening 80, and spring 92 connected between member 88 and member 86 urges stop 72 upwardly. The upward movement of stop 72 is limited by the pin 112. Thus, stop 72 can move horizontally and vertically within the confines of opening 80.

A roller 96 pivotally mounted to the end of arm 98 of switch 70 constantly engages stop 72. The electrical contacts associated with switch 70 are open when stop 72 is in a forward position as shown in FIG. 9 and are closed when stop 72 is in a rearward position as shown in FIG. 4.

Figure 9:
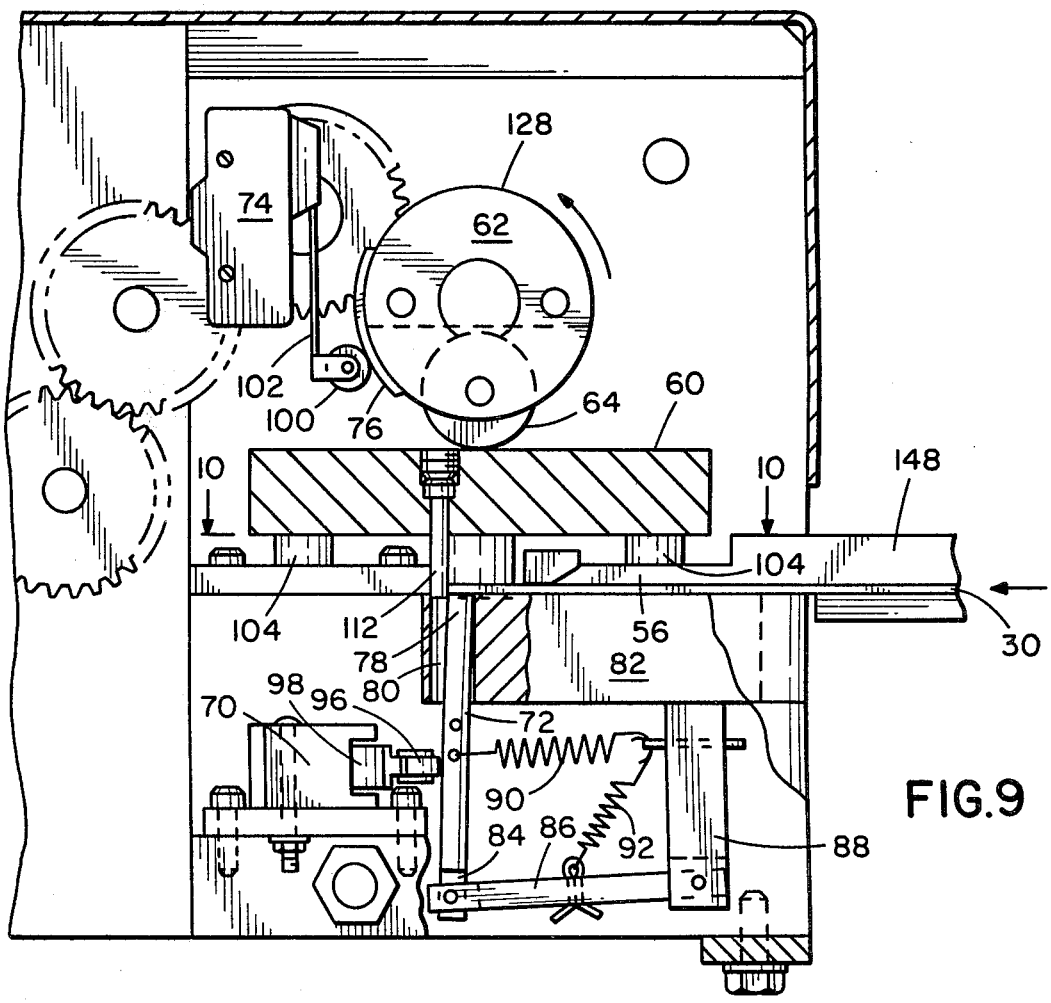
FIG. 9 is a cross-sectional side view of the notcher.

Electrical switch 74 as illustrated in FIG. 9 includes an arm 102 having pivotally mounted at its end a roller 100 which functions as a cam follower with respect to an outside surface of clutch member 128 which includes a raised cam portion 76. When roller 100 rides upon cam 76 as shown in FIG. 9, the electrical contacts of switch 74 are closed. The electrical contacts of switches 70 and 74 are connected in parallel between solenoid 68 and a suitable electrical power source so that the closure of either of the switches will energize the solenoid.

Figure 4:
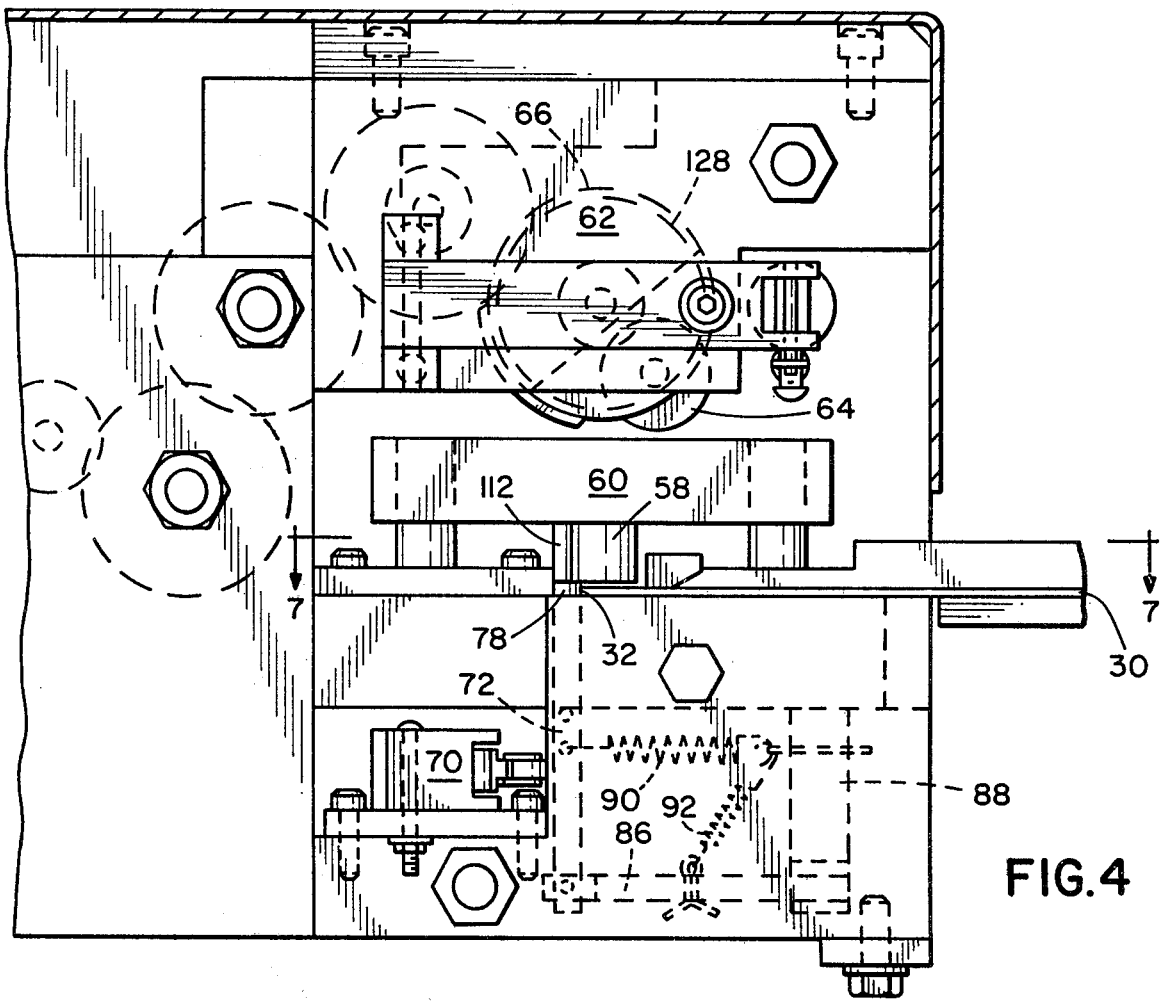
FIG. 4 is a fragmentary side view illustrating the notcher.

Ram 60 as shown in FIGS. 4 and 9 has a plurality of vertical rods 104 which are slidably received within holes 106 in member 108 of the apparatus. These rods serve to maintain ram 60 in a horizontal position and maintain punch 58 aligned with die 56 as the ram is reciprocated.

Figure 5:
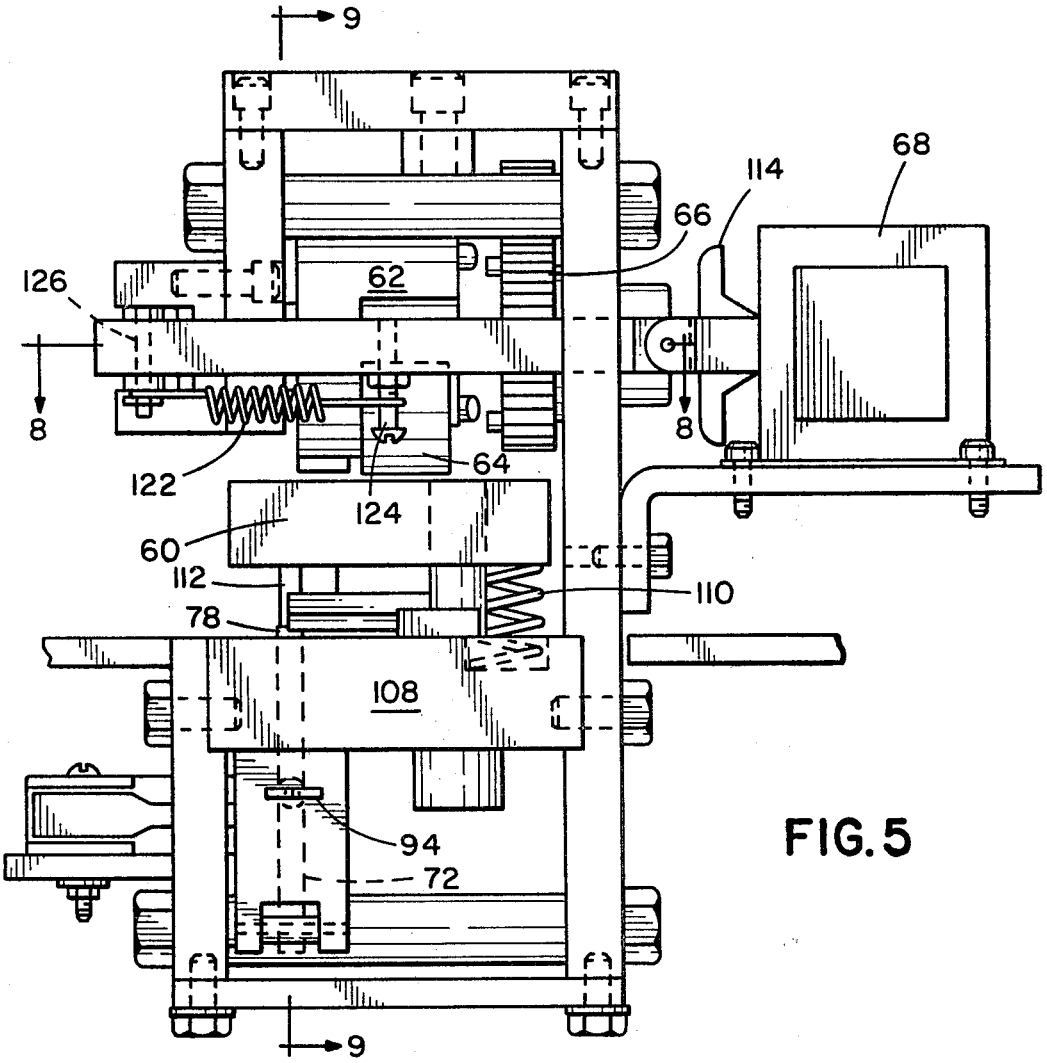
FIG. 5 is a partial front view of the apparatus illustrating the notcher.

As seen in FIG. 5, a spring 110 is disposed between member 108 and ram 60 to constantly urge the ram upwardly. Ram 60 has mounted thereto a pin 112 located so as to engage the upper end 78 of stop 72 when the ram is reciprocated downward and stop pin 72 is in the rearward position.

Figure 6:
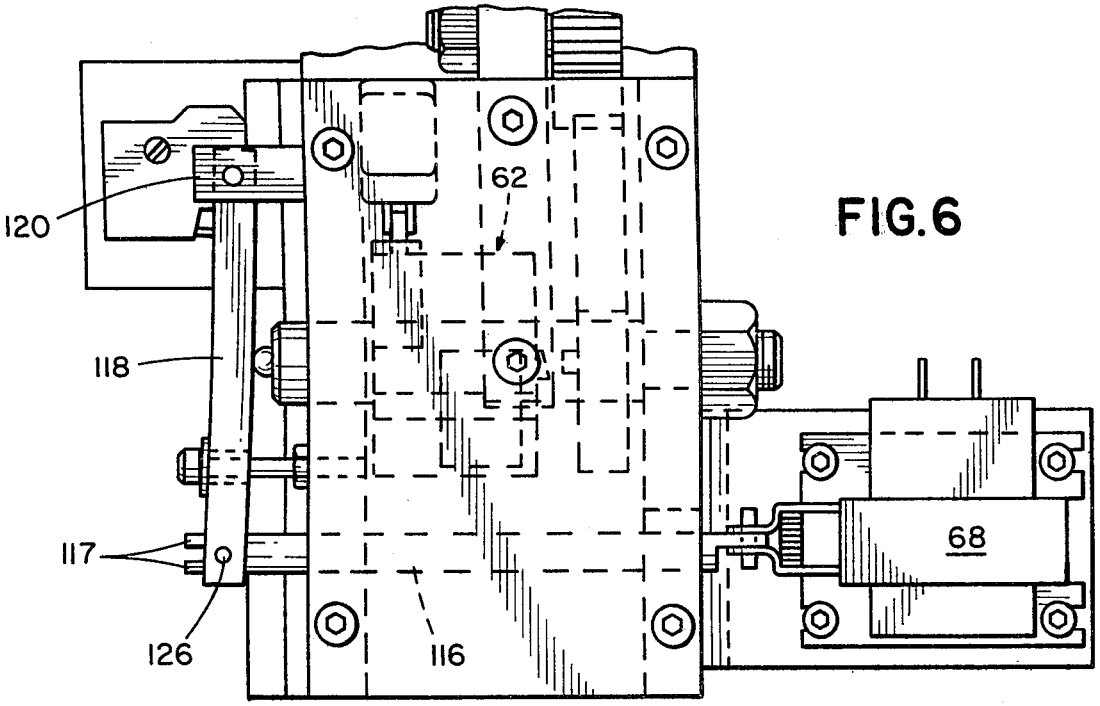
FIG. 6 is a fragmentary top view of the apparatus illustrating the notcher.
Figure 8:
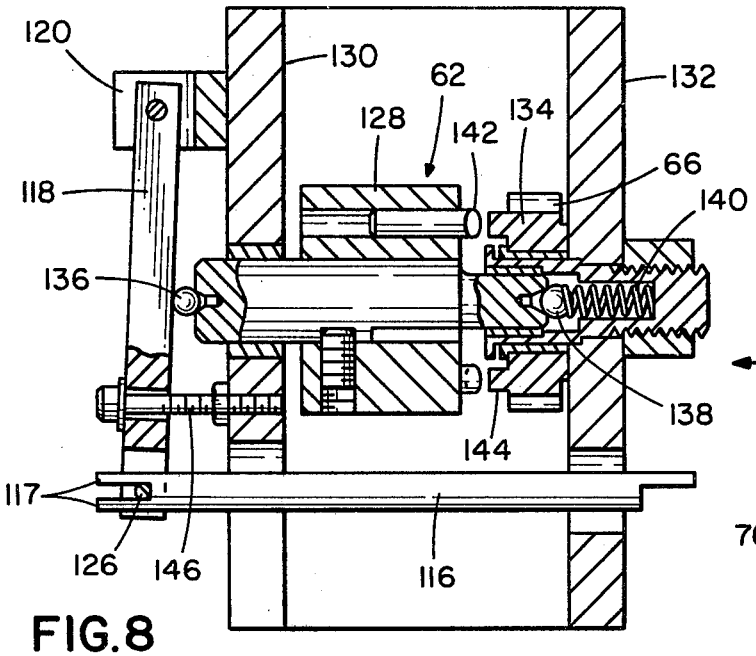
FIG. 8 is a cross-sectional view of the notcher taken about line 8—8 in FIG. 5.

FIGS. 5, 6 and 8 best illustrate the construction of clutch 62 and its operative relationship with solenoid 68 which is shown in its non-energized position. The movable armature 114 of the solenoid moves from left to right when the solenoid 68 is energized causing a corresponding movement in connected arm 116. One end of arm 118 is pivotally mounted to stationary member 120 and the other end is pivotally held within the forks 117 in the end of arm 116 by means of spring 122 connected between support 124 mounted to arm 116 and a pin 126 carried by the end of arm 118. Member 128 of clutch 62 is mounted between stationary supports 130 and 132 by means of bearings so that it is free to rotate and to move a limited horizontal distance so as to engage mating member 134 which is constantly driven by gear 66. Balls 136 and 138 extend outwardly along the center line from thne shaft of member 128 so as to engage arm 118 and a spring 140, respectively, which serves to constantly urge member 128 to its leftmost or disengaged position. Member 128 has a plurality of clutch pins 142 aligned to engage corresponding clutch pins 144 of mating clutch member 134 during the engaged condition. Member 134 is mounted to a gear 66 which is continuously driven by a series of coupling gears from an upper die roller gear which is driven from motor 30. A screw 146 threadedly engages member 130 and passes through a hole in arm 118 to act as a stop to limit the leftmost position of clutch member 128 as shown in FIG. 8.

OPERATION

As sheet 30 enters the apparatus it is initially guided by edge guide 148 as shown in FIG. 9. As the sheet enters the apparatus, ram 60 is in its uppermost position as shown in FIGS. 4 and 5 and stop pin 72 is in the forward position with its upper end 78 disposed upwardly beyond opening 80 so as to be in the path of the sheet as it is advanced from right to left. The electrical contacts of switches 70 and 74 are open so that solenoid 68 is not energized and clutch 62 not engaged.

Figure 7:
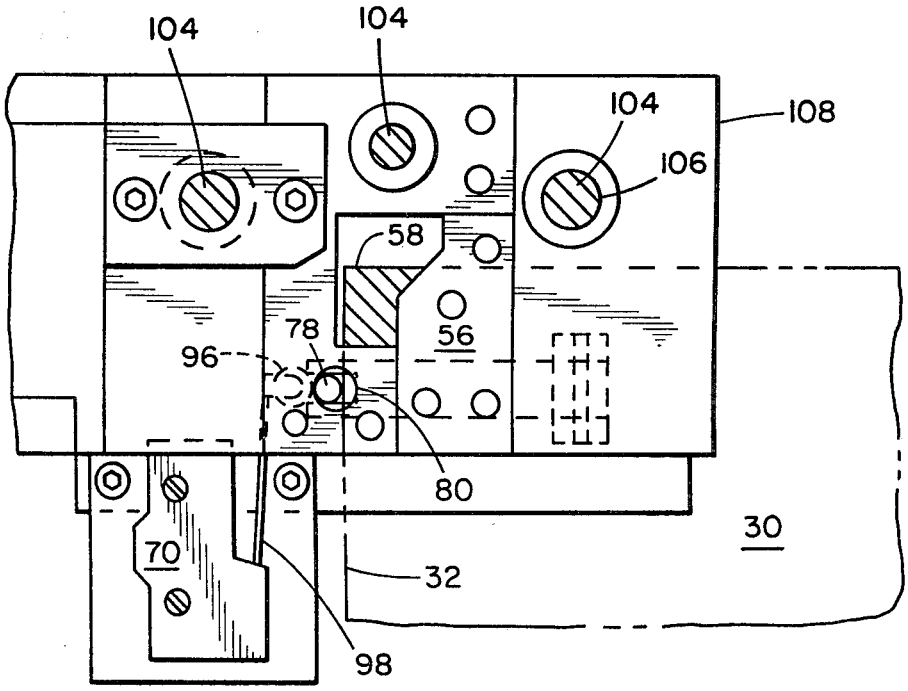
FIG. 7 is a partial cross-sectional view taken about line 7—7 in FIG. 4.

As sheet 30 continues to be advanced from right to left, its leading edge 32 abuts the upper end 78 of the stop and forces the latter from its forward position to its rearward position as shown in FIG. 7. Th stop and edge guide 148 serve to correctly position sheet 30 between die 56 and punch 58. The change from the forward to the rearward position of stop 72 is sensed by switch 70 whose contacts are closed when the pin is in its rearward position. The closure of contacts of switch 70 energizes solenoid 68 which in turn causes clutch 62 to engage causing clutch member 128 which carries eccentrically mounted wheel 64 to rotate in a counterclockwise direction. Just prior to the engagement of wheel 64 with the top of ram 60, cam following wheel 100 of switch 74 engages cam surface 76 causing the contacts of this switch to close thereby providing an alternate path for maintaining solenoid 68 energized.

As clutch member 128 continues to rotate counterclockwise, wheel 64 engages and drives downwardly ram 60 which carries punch 58 and pin 112. Pin 112 engages the top end 78 of the stop pin to drive the same downwardly while simultaneously punch 58 shears corner section 40 as it mates with die 56.

Figure 10:
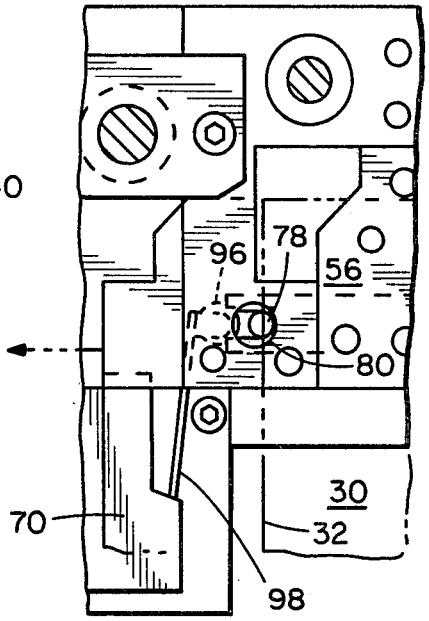
FIG. 10 is a fragmentary view taken about line 10—10 in FIG. 9.

FIG. 9 illustrates the maximum downward position of ram 60 as driven by wheel 64. In this position, punch 58 has sheared corner 40 and mates with die 56. Pin 112 extends below the bottom surface of sheet 30 and has driven the upper end 78 of stop pin 72 beneath sheet 30 which allows spring 90 to urge the stop pin to its forward position underneath the leading edge 32 of the sheet as illustrated in FIG. 10. Thus, stop pin 72 which initially engaged the leading edge 32 of the sheet has been displaced downwardly below the sheet.

As the stop pin 72 moves from its rearward to forward position, the contacts of switch 70 open; however, solenoid 68 remains energized by means of the closed contacts of switch 74. The cam surface 76 on clutch member 128 is disposed so as to maintain switch 74 closed after the stop pin 72 returns to its forward position to allow wheel 64 which engages ram 60 to continue rotating counterclockwise thereby allowing the ram 60 to return to its uppermost position. Cam follower 100 follows cam surface 76 until the latter ends thereby opening the contacts of switch 74, which de-energizes solenoid 68, which in turn permits spring 140 to disengage clutch 62, thus stopping the rotation of clutch member 128. Thus, notcher 62 has made one complete cycle and has returned to its original starting position for future cycles. The sheet 30 which has been punched can then be advanced from right to left so as to engage the initial die roller pair. As the trailing edge 38 exits over the upper end 78 of the stop, the stop is urged upwardly due to spring 92 so as to abut the leading edge of the next sheet to be punched.

One of the advantages of the present invention is that it permits a sheet of metal to be processed by a single apparatus from a flat sheet into a formed circular collar. Because the notcher of the embodiment of the present invention incorporates a clutch, a single motor can drive the entire apparatus. The movable stop pin both aligns the sheet prior to punching and serves as a means for detecting when a sheet is in position to be notched so that the ram can be operated.

While an embodiment of the present invention has been described above and illustrated in the drawings, it will be understood that various changes and modifications may be made in the described apparatus without departing from the scope of the invention as defined in the claims appended hereto.

What is claimed is:

1. In an apparatus for forming a circular collar from a generally rectangular sheet of metal, said apparatus including a means for notching one edge of said sheet and a motor which drives said apparatus, the improvement in means for notching said sheet comprising:

(a) a stationary die and a reciprocatory ram including a punch which cooperates with said die to stamp a notch in one edge of the sheet;

(b) means for aligning said sheet relative to said die and punch so that the area of the sheet to be notched is disposed between said die and punch, said aligning means comprising an edge guide and means disposed in the path of the sheet for abutting the leading edge of said sheet, said abutting means stopping said sheet such that the area of the sheet to be notched is disposed between said die and punch, said abutting means including a stop movable between a forward position and a rearward position, and a first spring connected to said stop for urging the latter to said forward position, the leading edge of the sheet abutting said stop to cause the latter to move from the forward position to the rearward position, and means mounted to said ram for displacing said abutting means from the path of said sheet upon operation of the reciprocatory ram; and (c) means responsive to movement of said stop for automatically operating said punch when a sheet to be notched has been positioned for stamping by said aligning means.

2. The apparatus according to claim 1 wherein said operating means comprises means coupled to said stop for detecting when the stop is in the rearward direction.

3. The apparatus according to claim 2 wherein said detecting means comprises an electrical switch which engages said stop, said switch having switch contacts which open and close in response to the movement of the stop between forward and rearward positions.

4. The apparatus according to claim 1 wherein said displacing means comprises a protruding member mounted to said ram for engaging said stop when the punch is reciprocated adjacent said die.

5. The apparatus according to claim 4 wherein said stop is mounted adjacent said die for movement substantially normal to said sheet between an upper position and a lower position, and includes a second spring which urges the stop toward the upper position, said protruding member engaging said stop to drive the latter from the upper position to the lower position.

6. The apparatus according to claim 5 wherein said first spring forces said stop from the rearward position to the forward position as the stop is forced by the protruding member to the lower position below said sheet thereby displacing the stop from abutting the leading edge of the sheet to allow the sheet to be advanced following the operation of the punch.

7. The apparatus according to claim 1 further comprising a drive member continuously driven by said motor, said operating means including a clutch coupled between said drive member and the ram, said clutch having an engaged position wherein drive is provided to reciprocally operate said ram and said clutch having a disengaged position wherein the ram is stationary.

8. In an apparatus for forming a metal sheet, the apparatus having an entry end and an exit end, and having feed rollers for driving the sheet to a forming station located intermediate the entry and exit ends, a forming tool at said station, said forming tool comprising a stationary die and a reciprocating ram, and actuating means engageable with a leading edge of the sheet for stopping the sheet at said station, the improvement wherein said feed rollers are continuously driven, and wherein said actuating means comprises a movable stop operating to arrest movement of the sheet during the forming operation, a drive means for said ram, a clutch associated with said drive means, additional actuating means responsive to movement of said stop upon contact by said leading edge for engaging of said clutch whereby said forming tool is operated by said drive means for working on said sheet while movement of the sheet is arrested, and including further actuating means mounted to said ram, said further actuating means engaging said stop and driving said stop away from its arresting position during the forming operation, said drive rollers automatically driving the sheet toward said exit end after completion of the forming operation.

9. An apparatus according to claim 8 wherein said forming tool forms a notch in said sheet.

10. An apparatus in accordance with claim 9 including means positioned intermediate said forming station and said exit end for deflecting said sheet into a cylindrical configuration.

11. An apparatus in accordance with claim 8 wherein said stop is movable between a forward position and a rearward position, and a first spring connected to said stop for urging the stop to said forward position, the leading edge of the sheet contacting said stop and causing the stop to move to said rearward position.

12. An apparatus according to claim 11 including a second spring normally urging said stop toward its arresting position, said stop being driven by said forming tool away from the arresting position in opposition to the action of said second spring, said second spring restoring said stop to the arresting position after said drive rollers drive the sheet away from said forming station.

13. An apparatus according to claim 8 wherein said forming tool includes a reciprocating ram, said drive means comprising a rotating eccentric means operating to drive said ram toward the sheet and away from the sheet upon engagement of said clutch.

14. An apparatus according to claim 13 including electrically energized means for shifting the clutch between engaged and disengaged condition, first switch means interposed between said stop and said electrically energized means, said first switch means being operated upon movement of said stop by said leading edge.

15. An apparatus according to claim 14 including a second switch means interposed between said second switch means and said electrically energized means, said second switch means operating to maintain the electrically energized means energized after said stop is driven away from its eccentric position, and until completion of the forming operation.

* * * * *